US009299285B2

(12) United States Patent
Yang et al.

(10) Patent No.: US 9,299,285 B2
(45) Date of Patent: Mar. 29, 2016

(54) TIMING SCRAMBLING METHOD AND TIMING CONTROL CIRCUIT THEREOF

(71) Applicant: NOVATEK Microelectronics Corp., Hsin-Chu (TW)

(72) Inventors: Shun-Hsun Yang, Hsinchu (TW); Chia-Wei Su, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 94 days.

(21) Appl. No.: 14/010,502

(22) Filed: Aug. 26, 2013

(65) Prior Publication Data

US 2014/0160183 A1 Jun. 12, 2014

(30) Foreign Application Priority Data

Dec. 10, 2012 (TW) ..... 101146424 A

(51) Int. Cl.
*G09G 3/36* (2006.01)
*G09G 3/20* (2006.01)

(52) U.S. Cl.
CPC ..... *G09G 3/2096* (2013.01)

(58) Field of Classification Search
None
See application file for complete search history.

(56) References Cited

U.S. PATENT DOCUMENTS

| | | | | |
|---|---|---|---|---|
| 8,275,129 | B2 | 9/2012 | Meng | |
| 2011/0199368 | A1* | 8/2011 | Huang | G09G 3/20 345/213 |
| 2011/0199369 | A1* | 8/2011 | Huang | G09G 3/20 345/213 |
| 2011/0311044 | A1* | 12/2011 | Westerveld | H04N 7/163 380/210 |
| 2012/0146965 | A1* | 6/2012 | Baek | G09G 3/006 345/204 |

FOREIGN PATENT DOCUMENTS

| | | | |
|---|---|---|---|
| CN | 1667684 | A | 9/2005 |
| CN | 101669365 | A | 3/2010 |
| CN | 102184696 | A | 9/2011 |
| CN | 102542971 | A | 7/2012 |
| JP | 63296424 | * | 12/1988 |
| JP | 63296424 | A * | 12/1988 |
| KR | 1020120019838 | A | 3/2012 |
| TW | 201137821 | | 11/2011 |
| TW | 201227677 | | 7/2012 |
| TW | 201419240 | | 5/2014 |

* cited by examiner

*Primary Examiner* — Jason Olson
*Assistant Examiner* — Krishna Neupane
(74) *Attorney, Agent, or Firm* — Winston Hsu; Scott Margo

(57) ABSTRACT

A timing scrambling method, for a timing control device corresponding to a plurality of source driving devices, includes adjusting a selecting signal according to a clock signal; selecting one of a plurality of scrambling generating units according to the selecting signal to generate a timing scrambling signal; and generating scrambling data for the plurality of source driving devices according to the timing scrambling signal.

8 Claims, 5 Drawing Sheets

TIMING SCRAMBLING METHOD AND TIMING CONTROL CIRCUIT THEREOF

BACKGROUND OF THE INVENTION

1. Field of the Invention

The present invention relates to a timing scrambling method and timing control device thereof, and more particularly, to a timing scrambling method and timing control device thereof capable of adjusting a scrambling signal with time.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, especially in the large-size LCD family. A driving system installed in the LCD, includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of TFTs to turn on the TFTs on the panel. The source drivers are responsible for converting digital image data, sent by the timing controller, into analog voltage signals and outputting the voltage signals to sources of the TFTs. When the TFT receives the voltage signals, a corresponding liquid crystal molecule has a terminal whose voltage changes to equalize the drain voltage of the TFT, and thereby changes its own twist angle. The rate that light penetrates the liquid crystal molecule is changed accordingly, and thus different colors can be displayed on the panel.

The driving signals of the source drivers are generated by a timing controller. With advancements in LCD panel size, image resolution, and high data rates, high speed transmitting interfaces or more transmitting channels are required for transmitting data between the source drivers and the timing controller. Electric magnetic interruption (EMI) is significantly increased while transmitting considerable data between the source drivers and the timing controller, however. Prior art solutions reduces the electric magnetic interruption by narrowing swings of the signals between the source drivers and the timing controller through the utilization of a spread spectrum clock generator (SSCG), or a scrambling code, wherein the scrambling code is the most common method of reducing the electric magnetic interruption. The concept of reducing the electric magnetic interruption via the scrambling code is to scramble the regularity of data.

Please refer to FIG. 1, which is a schematic diagram of a conventional timing controller 10. The timing controller 10 adopts the scrambling code for decreasing the electronic magnetic interruption in a liquid crystal display. As shown in FIG. 1, the timing controller 10 generates data SD_SD1-SD_SDN for source drivers SD1-SDN by scrambling data D_SD1-D_SDN according to a timing scrambling signal. The timing scrambling signal is generated by a random number generator 100. The source drivers SD1-SDN generate the same timing scrambling signal via the random number generator 100 of each source drivers SD1-SDN, and then acquire the original data D_SD1-D_SDN via decoding the received data SD_SD1-SD_SDN according to the timing scrambling signal. The distribution of the electronic magnetic interruption on the spectrum becomes more dispersive and the peak of the electronic magnetic interruption can therefore be reduced.

Since the timing controller 10 only uses the random number generator 100 to generate the timing scrambling signal, however, the data SD_SD1-SD_SDN will have similar patterns when the data D_SD1-D_SDN are fixed. In such a condition, adopting the scrambling code for reducing the electronic magnetic interruption is ineffective.

SUMMARY OF THE INVENTION

Therefore, the present invention provides a timing scrambling method and timing control device thereof for further reducing the electronic magnetic interruption.

The present invention discloses a timing scrambling method for a timing control device corresponding to a plurality of source driving devices. The timing scrambling method comprises adjusting a selecting signal according to a clock signal; selecting one of a plurality of scrambling generating units according to the selecting signal to generate a timing scrambling signal; and generating scrambling data for the plurality of source driving devices according to the timing scrambling signal.

The present invention further discloses a timing control device. The timing control device comprises a select signal generating module, for adjusting a select signal according to a clock signal; and a plurality of data generating modules, each data generating module corresponding to one of a plurality of source driving devices which comprises: a plurality of random-number generating units, for generating a plurality of timing scrambling signals; a selecting unit, coupled to the select signal generating module, for selecting one of the plurality of timing scrambling signals as a scrambling input signal; and a scrambling unit, coupled to the selecting unit, for generating scrambling data according to the scrambling input signal and source driving data of the corresponding source driving device.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
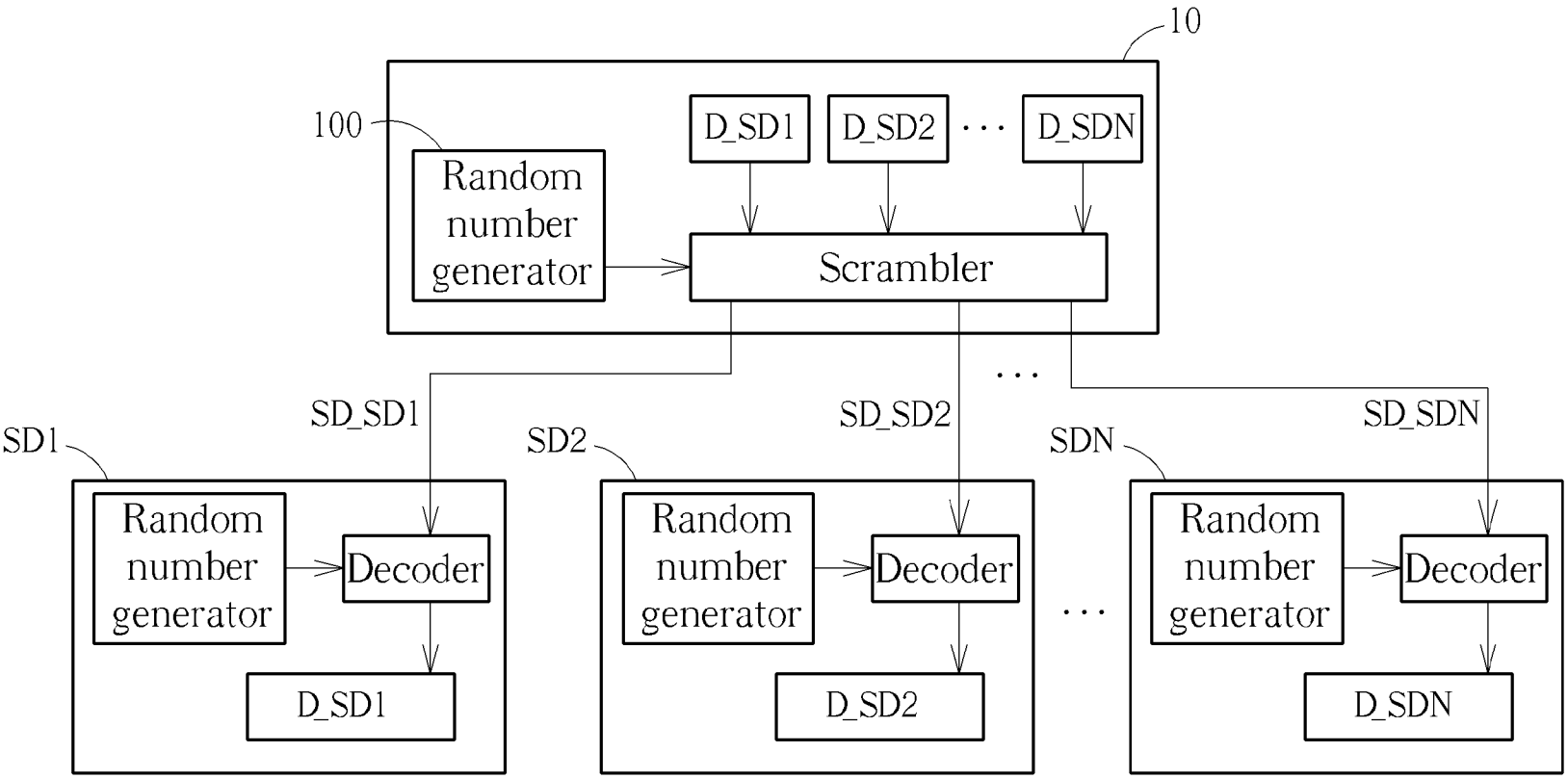
FIG. 1 PRIOR ART
FIG. 1 is a schematic diagram of a conventional timing controller.
Figure 2:
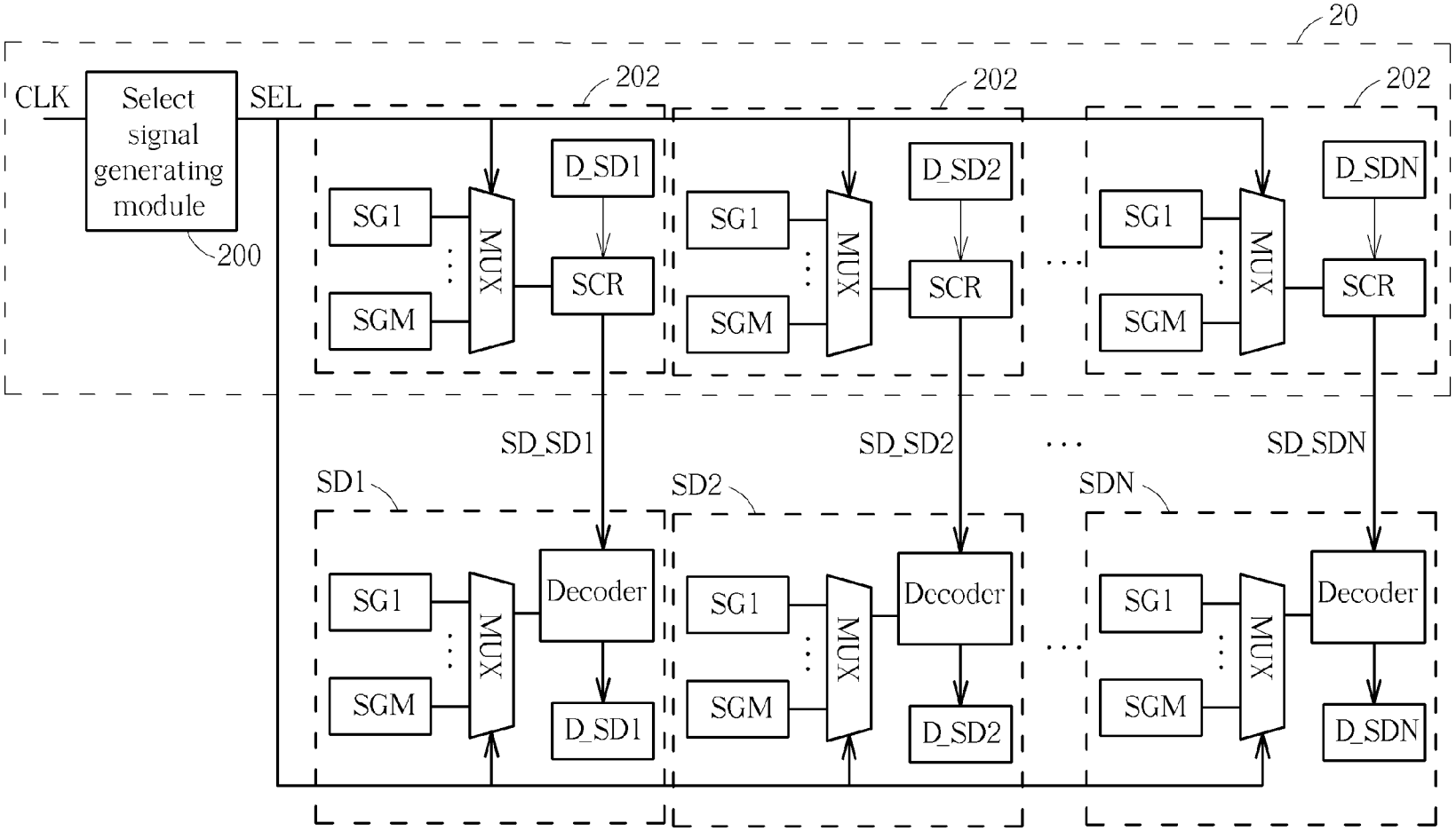
FIG. 2 is a schematic diagram of a timing control device according to an embodiment of the present invention.

Please refer to FIG. 2, which is a schematic diagram of a timing control device 20 according to an embodiment of the present invention. The timing control device 20 is utilized for scrambling data D_SD1-D_SDN, so as to generate data SD_SD1-SD_SDN for source driving devices SD1-SDN. As shown in FIG. 2, the timing control device 20 comprises a select signal generating module 200 and a plurality of data generating modules 202. The select signal generating module 200 is utilized for adjusting a selecting signal SED according to a clock signal CLK. In an embodiment, the select signal generating module 200 is a counter. Each data generating module 202 comprises a selecting unit MUX, random number generating units SG1-SGM and a scrambling unit SCR. The data generating module 202 generates the scrambling data SD_SD1-SD_SDN according to the selecting signal SEL and the data D_SD1-D_SDN, and then outputs the scrambling data SD_SD1-SD_SDN to the source driving devices SD1-SDN separately. As a result, the timing control device 20 can select different random number generating units for performing scrambling data at different times according to the clock signal CLK. A time factor is added in the scrambling degrees of the transmission channels between the timing control device 20 and the source driving devices SD1-SDN. The scrambling degrees of the transmission channels can be more random and the electronic magnetic interruption of the transmission channels can be further decreased.

In detail, the select signal generating module 200 adjusts the selecting signal SEL when the clock signal CLK instructs a next clock period to start, for making the selection unit MUX of each data generating module 202 select the timing scrambling signal to be different from a previous clock period as the scrambling input signal SCR_IN. In other words, the scrambling unit SCR of each data generating module 202 uses the timing scrambling signal generated by different random number generating units in different clock periods as the scrambling input signal SCR_IN, for generating the scrambling data SD_SD_1~SD_SDN. In the same clock period, the source driving devices SD1-SDN selects the random number generating unit selected by the selecting unit MUX in the data generating modules 202, for decoding the scrambling data SD_SD1~SD_SDN. Via selecting different random number generating units to generate the scrambling input signal SCR_IN in different clock periods according to the clock signal CLK, the time factor is added in the transmission channels between the timing control device 20 and the source driving device SD1-SDN The electronic magnetic interruption of the transmission channels can thereby be further decreased. Please note that, since the scrambling input signal is generated by different random number generating units in different clock periods, the scrambling data SD_SD1-SD_SDN do not have similar patterns even if the data D_SD1-D_SDN do not vary with time. The electronic magnetic interruption is therefore decreased.

Figure 3:
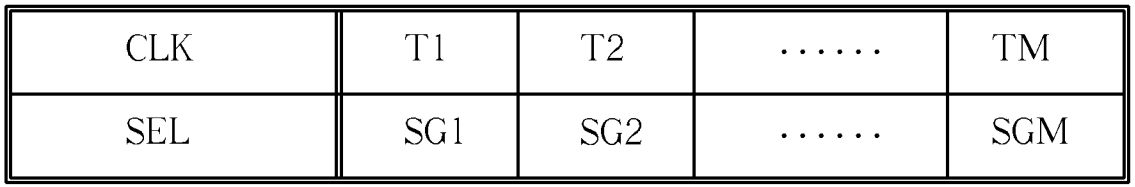
FIG. 3 is a schematic diagram of an example of relationships between the random number generating unit being selected and time.

Please refer to FIG. 3. As shown in FIG. 3, the select signal SEL instructs the selecting unit MUX of each data generating module 202 to select the random number generating unit SG1 in a clock period T1. When the clock signal indicates that a clock period T2 starts, the select signal SEL is switched to instruct the selecting unit MUX to select the random number generating unit SG2, and so on. The random number generating unit instructed by the select signal SEL sequentially changes from the random number generating unit SG1 to the random number generating unit SGM when the clock periods instructed by the clock signal CLK vary from the time period T1 to the time period TM. Accordingly, the time factor is added in the transmission channels between the timing control device 20 and source driving devices SD1-SDN.

Please note that, the timing control device of the above embodiment adds the time factor in the transmission channels between the timing control device and the source driving device via selecting different random number generating units to generate the timing scrambling signal used for scrambling data. The electronic magnetic interruption of the transmission channels can be further decreased. According to different applications, those skilled in the art may observe appropriate alternations and modifications. For example, the random number generating units SG1-SGM may comprise a random number generating unit generating a timing scrambling signal with zero scrambling degree. When the random number generating unit generating a timing scrambling signal with zero scrambling degree is selected, the scrambling data SD_SD1-SD_SDN generated by the scrambling unit SCR equal the data D_SD1-D_SDN. As a result, the electronic magnetic interruption of the transmission channels between the timing control device and source driving devices can be further reduced.

Figure 4:
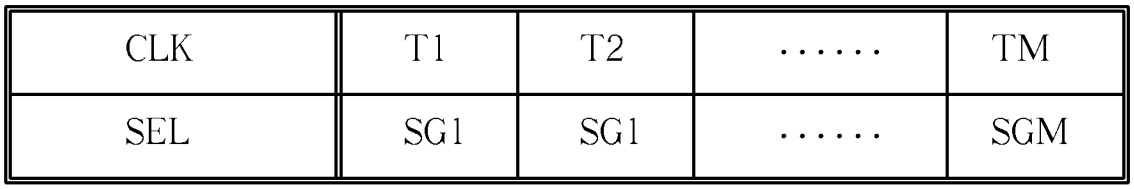
FIG. 4 is a schematic diagram of another example of relationships between the random number generating unit being selected and time.

Please refer to FIG. 4, which is a schematic diagram of another example of the relationship between time and the random number generating unit being selected. As shown in FIG. 4, the select signal SEL indicates the random number generating unit SG1 in both the clock period T1 and clock period T2. Furthermore, the select signal SEL may indicate the random number generating unit SG1 in other clock periods among the clock periods T3-TM. The time period and frequency of each random number generating unit being selected is changed. The scrambling degree of transmission channels between the timing control device 20 and the source driving devices SD1-SDN can be more random. In other words, the timing control device 20 can make the scrambling degree of the transmission channels more random via changing time period or frequency of each random number generating unit being selected.

Figure 5:
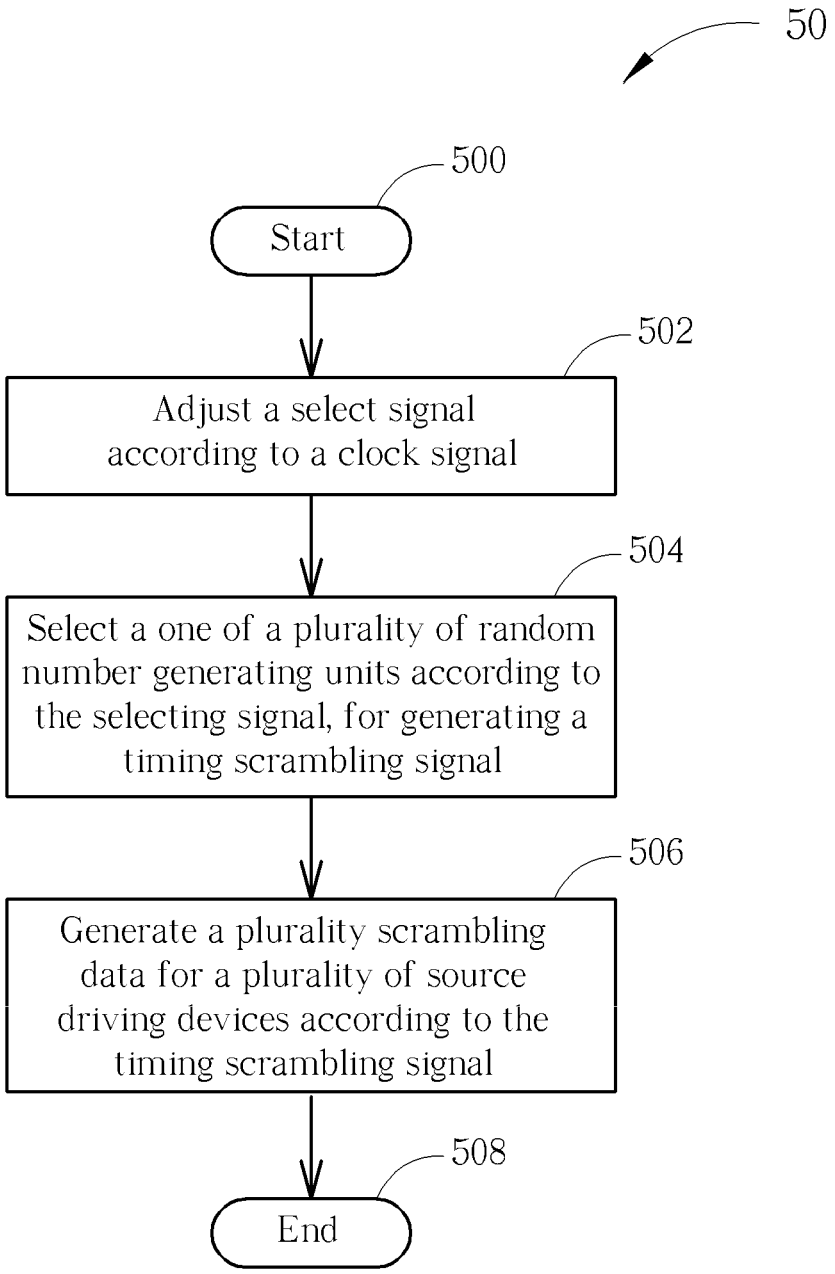
FIG. 5 is a flow chart of a timing scrambling method according to an embodiment of the present invention.

The method of the timing control device 20 selecting different random number generating units for scrambling data in different clock periods can be further summarized to a timing scrambling method 50. Please refer to FIG. 5. Noticeably, the timing scrambling method 50 is not limited to the sequence shown in FIG. 5 if a same result can be obtained. The timing scrambling method 50 is utilized in a timing control device and comprises the following steps:

Step 500: Start.

Step 502: Adjust a selecting signal according to a clock signal.

Step 504: Select a one of a plurality of random number generating units according to the selecting signal, for generating a timing scrambling signal.

Step 506: Generate a plurality of scrambling data for a plurality of source driving devices according to the timing scrambling signal.

Step 508: End.

According to the timing scrambling method 50, the scrambling data can be more random and the electronic magnetic interruption between the timing control device and the source driving devices can be further decreased. The detailed operations of the timing scrambling method 50 can be known by referring to the above, and are not narrated herein for brevity.

To sum up, the timing scrambling method and timing control device thereof of the above embodiment select different random number generating units in different clock periods to generate the timing scrambling signal used for scrambling data. The electronic magnetic interruption between the timing control device and the source driving devices can be further decreased. Noticeably, the timing scrambling method and timing control device thereof of the above embodiment effectively reduces the electronic magnetic interruption even if the input data of the timing control device do not vary with time.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A timing scrambling method, for a timing control device corresponding to a plurality of source driving devices, the timing scrambling method comprising:

selecting a first timing scrambling signal of a first scrambling generating unit among a plurality of scrambling generating units in a first period of a clock signal as a scrambling input signal;

selecting a second timing scrambling signal of a second scrambling generating unit among the plurality of scrambling generating units in a second period of the clock signal as the scrambling input signal, wherein the second period is subsequent to the first period; and generating scrambling data for the plurality of source driving devices according to the scrambling input signal and source driving data of the corresponding source driving device.

2. The timing scrambling method of claim 1, wherein each of the first period and the second period comprises only a clock cycle of the clock signal.

3. The timing scrambling method of claim 1, wherein each of the first period and the second period comprises a plurality of clock cycles of the clock signal.

4. The timing scrambling method of claim 1, wherein the plurality of scrambling generating units comprises a scrambling generating unit which generates the timing scrambling signal indicating outputting the source driving data as the scrambling data.

5. A timing control device, comprising:

a select signal generating module, for adjusting a select signal according to a clock signal; and a plurality of data generating modules, each data generating module corresponding to one of a plurality of source driving devices and comprising:

a plurality of random-number generating units, for generating a plurality of timing scrambling signals;

a selecting unit, coupled to the select signal generating module, for selecting one of the plurality of timing scrambling signals as a scrambling input signal; and a scrambling unit, coupled to the selecting unit, for generating scrambling data according to the scrambling input signal and source driving data of the corresponding source driving device;

wherein the selecting unit selects a first timing scrambling signal among the plurality of timing scrambling signals as the scrambling input signal in a first period of the clock signal and selects a second timing scrambling signal among the plurality of timing scrambling signals as the scrambling input signal in a second period of the clock signal;

wherein the second period is subsequent to the first period.

6. The timing control device of claim 5, wherein each of the first period and the second period comprises only a clock cycle of the clock signal.

7. The timing control device of claim 5, wherein each of the first period and the second period comprises a plurality of clock cycles of the clock signal.

8. The timing control device of claim 5, wherein the plurality of scrambling generating units comprises a scrambling generating unit which generates the timing scrambling signal indicating outputting the source driving data as the scrambling data.

* * * * *